United States Patent [19]

Hamilton

[11] Patent Number: 4,920,597

[45] Date of Patent: May 1, 1990

[54] DRIVE-ON VEHICLE SUPPORTING ARRANGEMENT

[75] Inventor: Harold F. Hamilton, McPherson, Kans.

[73] Assignee: Hein-Werner Corporation, Waukesha, Wis.

[21] Appl. No.: 269,200

[22] Filed: Nov. 9, 1988

[51] Int. Cl.[5] ..... E01D 1/00

[52] U.S. Cl. ..... 14/69.5; 254/88

[58] Field of Search ..... 14/69.5, 71.1; 254/88, 254/89 R, 90, 93 L; 52/175; 248/352; 414/537

[56] References Cited

U.S. PATENT DOCUMENTS

| | | | |
|---|---|---|---|
| 1,528,934 | 3/1925 | McMahon | 254/88 |
| 1,538,437 | 5/1925 | Larsen | 254/88 |
| 1,540,068 | 6/1925 | Harvey | 254/89 R |
| 1,993,387 | 3/1935 | Smith | 254/88 X |
| 2,008,929 | 7/1935 | Scherer | 254/88 |
| 2,576,544 | 11/1951 | Smith | 254/88 X |
| 3,216,530 | 11/1965 | Hunter | 254/88 X |
| 3,990,207 | 11/1976 | Eck et al. | 52/704 |
| 4,238,003 | 12/1980 | Hunter | 254/88 X |
| 4,447,042 | 5/1984 | Masui | 254/90 |
| 4,560,131 | 12/1985 | Eck | 248/352 |
| 4,828,222 | 5/1989 | Rossato | 254/88 |

*Primary Examiner*—Jerome W. Massie
*Assistant Examiner*—Matthew Smith, IV
*Attorney, Agent, or Firm*—Wm. Bruce Day

[57] ABSTRACT

A drive-on vehicle supporting arrangement for use with a floor anchor system includes a pair of parallel, spaced vehicle supporting treadways, each of which includes vehicle support stands secured to floor anchors to affix the support stand to the floor and clamps to connect to the undercarriage of a vehicle. Removable treadways are positioned between front and rear vehicle support stands. Additionally, a front treadway extends forwardly from the front vehicle support stand and a rear treadway extends rearwardly from the rear vehicle support stand and are supported by treadway support stands. A ramp leads to the rear treadway so that the repairman can drive a vehicle onto the treadway surface, elevate the vehicle, if necessary, by portable jacks and secure the vehicle atop the support stands. Thereafter, the treadways may be removed for clear access to the underside of the vehicle to facilitate repair.

4 Claims, 1 Drawing Sheet

DRIVE-ON VEHICLE SUPPORTING ARRANGEMENT

FIELD OF THE INVENTION

The present invention relates to floor anchoring systems for use as tie downs in vehicle frame and body repair shops and more particularly to car stand or anchor stand devices for use in a floor anchor system.

BACKGROUND OF THE INVENTION

Tie down devices are used for anchoring one end of chain or cable or other such member for securing a vehicle, stand or the like to the floor, whereby the anchored member is restrained from movement. It is imperative that a vehicle must be restrained or held fast in position so that sideward pulls and pushes may be applied to the vehicle to correct damaged frame and body portions. Generally, in body shops, these tie down devices are arranged in a grid pattern in a poured concrete floor and are spaced at proper intervals to allow ready connection to portions of a vehicle desired to be restrained. The tie down devices are normally embedded in the floor by a drill core of approximately four inches in diameter being removed and an anchor pot, or tie down device, being emplaced and secured. One such tie down device is disclosed in U.S. Pat. No. 3,990,207, owned by the assignee of the present invention, and includes a wedge member movable through the bore of a body member so as to deform cantilevered segments in a radial pattern beyond a normal outer diameter of the body member to grip the surrounding concrete wall of the bore.

Chains or other such connecting members are attachable to the tie down device because, as shown in the above '207 patent, a top member of the tie down device includes a cross shaped aperture into which a chain may be inserted. Certain car stands may also serve as anchoring devices, provided that they include a means for secure connection to the tie down device. One such stand is shown in U.S. Pat. No. 4,560,131, also owned by the assignee hereof and which discloses a stand having a rectangular base, a rectangular pyramidal base with a pinchweld clamp arrangement at the top and an anchor bolt and nut to longitudinally draw the bolt and securely attach the stand to the anchor pot. In order to position a vehicle upon the anchor stand shown in the '131 patent, the vehicle had to be elevated as by floor jacks, with the wheels placed on movable dollies and moved to a position over the floor anchor grid system. Thereafter, the anchor stands of the '131 patent are placed under the vehicle, the pinchweld clamps secured to the vehicle and the anchor bolts connected to the floor pot and tightened.

The present invention provides a drive-on vehicle supporting arrangement which is particularly adapted for economical operation and provides, at low cost to the garage owner, a quick elevation system using removable treadways whereby a vehicle can be driven up ramps onto an elevated treadway, secured atop vehicle support stands whereby the vehicle is restrained from movement and then the treadways removed for freedom of access to the vehicle to facilitate repair.

OBJECTS OF THE INVENTION

The principal objects of the present invention are: to provide a drive-on vehicle support arrangement for securing a vehicle while forces are applied thereto to correct damage to the vehicle frame and body; to provide a drive-on vehicle support arrangement elevating the vehicle so that mechanical maintenance may be performed thereon; to provide a low cost system particularly for the budget minded garage owner enabling him to save time yet having the capability to sufficiently restrain the vehicle so that all corrective measures may be applied thereto; to provide such a vehicle support arrangement with vehicle support stands including vehicle engaging devices that are removable so that the vehicle may be driven over the support stands; to provide such a vehicle support arrangement having removable portions to facilitate access to the vehicle for repair; to provide such a vehicle support arrangement which does not impair a worker's ability to maneuver about the vehicle; to provide such a vehicle support arrangement including an anchor stand which can accommodate forces applied from any expected direction without requiring additional adjustment; and to provide such a vehicle support arrangement which is relatively inexpensive, sturdy and efficient in use, and particularly well adapted for the intended purpose.

Other objects and advantages of this invention will become apparent from the following description taken in connection with the accompanying drawings wherein are set forth, by way of illustration and example, certain embodiments of this invention.

DETAILED DESCRIPTION OF THE INVENTION

Figure 1:
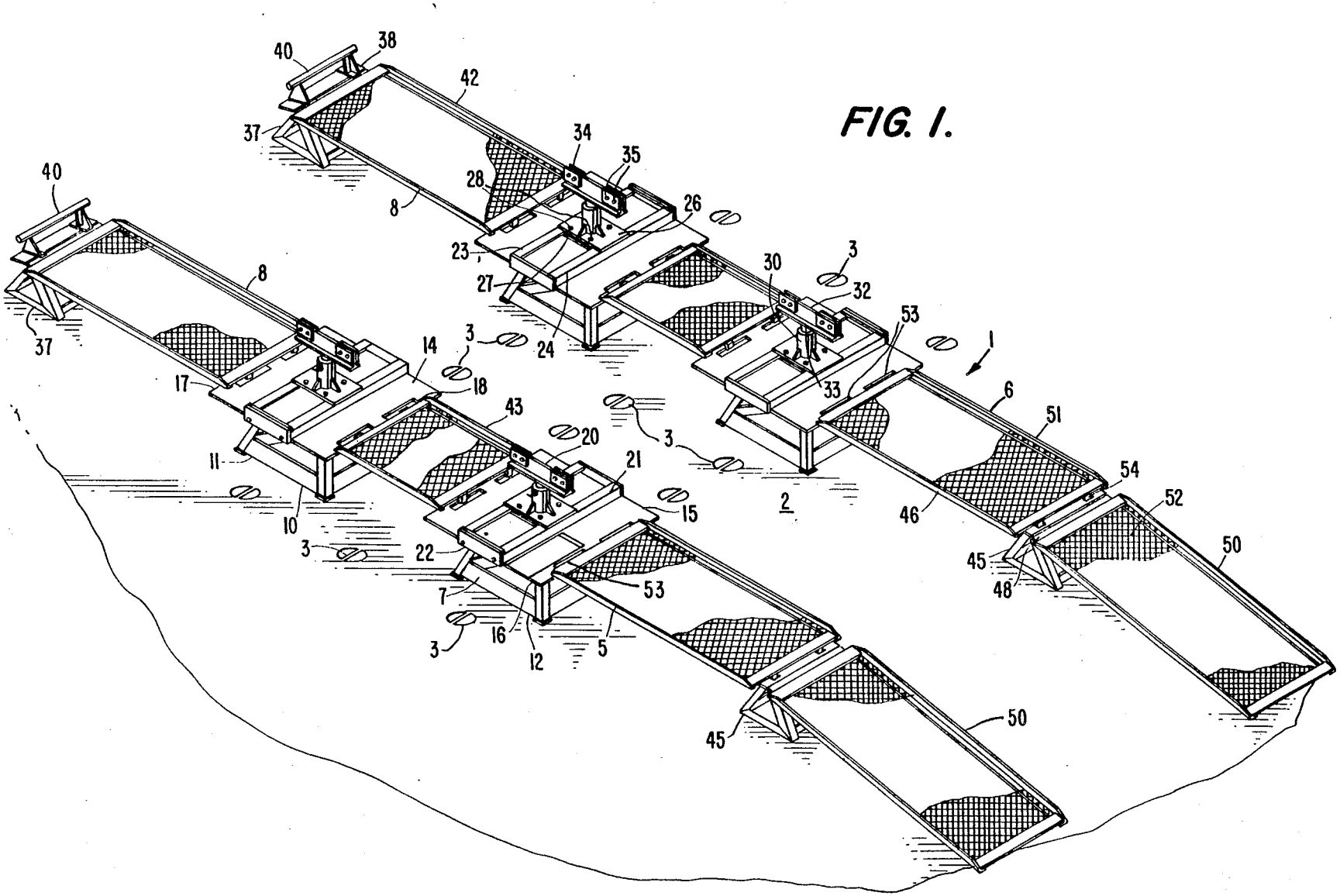
FIG. 1 is a perspective view of a drive-on vehicle support arrangement according to the present invention.

As required, a detailed embodiment of the present invention is disclosed herein, however, it is to be understood that the disclosed embodiment is merely exemplary of the invention which may be embodied in various forms. Therefore, specific structural and functional details disclosed herein are not to be interpreted as limiting, but merely as basis for the claims and as a representative basis for teaching one skilled in the art to variously employ the present invention in virtually any appropriately detailed structure.

Referring to the drawing in more detail:

The reference numeral 1, FIG. 1, generally indicates a drive-on vehicle support arrangement embodying the present invention and which is used for elevating and anchoring an automobile (not shown) to a garage floor 2, thus securing the vehicle in place so that repair may be undertaken. The garage floor 2 includes a grid of tie down devices 3, such as shown in U.S. Pat. No. 3,990,207, although other such tie down devices are known and are suitable for use with the vehicle support arrangement 1.

The vehicle support arrangement 1 generally includes a pair of parallel, vehicle supporting treadways 5 and 6, each of which includes vehicle support means 7 and various treadway segments 8 which together form an elevated surface for driving a vehicle onto the vehicle support arrangement, restraining it from movement and then removing the treadway segments 8 as necessary for free access to the undercarriage of the vehicle.

In the illustrated example, the vehicle support means 7 are similar to that shown in U.S. Pat. No. 4,560,131, commonly owned herewith, each including a generally rectangular pyramidal stand 10 including a floor engagement means extending downwardly therefrom, such as the bolt and nut arrangement shown in our '131 patent and which connects into the tie down device 3. In the illustrated example, there are two such stands with each of the treadways 5 and 6, including a front stand 11 and a rear stand 12 and spaced so that each is positioned between the front and rear wheels of a vehicle and respectively adjacent thereto. Each stand 10 includes a relatively broad, flat upper plate 14 having opposite sides 15 and 16 and front and rear margins 17 and 18.

A vehicle engagement means 20 extends upwardly from the plate 14 for connection to the undercarriage of a vehicle and in the illustrated example, includes a generally rectangular framework 21 with opposite end flanges 22 which fit over the sides 15 and 16 of the stand plate 14. The rectangular framework 21, is movable longitudinally fore and aft on the stand plate 14 to accommodate variations in vehicle configuration and, because the flanges 22 preferably merely fit over the sides 15 and 16, the vehicle engagement means 20 is removable from the stand 10 so that a vehicle may be driven thereover. The rectangular framework 21 includes spaced rails 23 and 24 such as of ninety degree angle beam shape whereby a slidable base plate 26 rests atop the rails 23 and 24 and with a clamp plate 27 thereunder and tightenable against the rails 23 and 24 via bolts 28. The base plate 26 is slidable laterally of the treadways 5 and 6 on the rails 23 and 24, also to accommodate variations in vehicle configuration.

For height adjustment, an outer socket 30 is secured to the base plate 26 and extends upwardly therefrom. Although various types of vehicle engaging devices may be used, in the illustrated example, a pinchweld clamp 32 is depicted and includes a spindle 33 received into the outer socket 30 and rotatable therein. Spaced jaws 34 are connected by bolts 35 and are tightenable about the pinchweld of a vehicle for securing same.

In the illustrated example, each of the treadways 5 and 6 includes a front treadway support stand 37 positioned forwardly of the front vehicle support stand 11. The front treadway support stand 37 is generally triangularly pyramidal in shape and extends upwardly a sufficient height to position a top plate 38 secured thereto the same distance above a floor surface as the vehicle support stand plate 14. A vehicle stop 40 is mounted adjacent a forward margin of the top plate 38. A front treadway 42 extends between the front treadway support stand 37 and the front vehicle support stand 11. Similarly, a middle treadway 43 extends between the front and rear vehicle stands 11 and 12. A rear treadway support stand 45, similar in appearance to the front treadway support stand 37 but without the vehicle stop therewith, is positioned rearwardly of the rear vehicle support stand 12 and in spaced relation thereto. A rear treadway 46 extends between the rear vehicle support stand 12 and the rear treadway support stand 45. The rear treadway support stand 45 has a downwardly inclined rear lip 48 to which an inclined ramp 50 is connectible and which extends between the rear treadway support stand 45 and the floor surface.

In the illustrated example, each of the treadways, including the front treadway 42, middle treadway 43, rear treadway 46 and the ramp 50 is formed of a sturdy rectangular framework 51 and with the wheel supporting surface 52 of sturdy wire mesh for lightness in weight. Means for removably connecting the treadways 42, 43, and 46 extend between each of the respective stands 11, 12, 37 and 45 and in the illustrated example, include apertures such as slots 53 formed adjacent the stand margin. The treadways have lugs or tabs 54 which fit into the slots 53 and removably secure the treadways to the respective stands. The ramp 50 is removably connected to the rear treadway support stand 45 in a like manner.

Preferably, the treadway support stands 37 and 45 are not secured to the floor but are merely positioned thereon so as to be removable at the discretion of the workman. Accordingly, in use, the workman may remove the vehicle engagement means 20 from atop the vehicle support stand plates 14 to clear the treadways 5 and 6 of obstructions. He then drives the vehicle up the ramps 50 and onto the elevated surface formed by the front treadway 42, front vehicle support stand plate 14, middle treadway 43, rear vehicle support stand plate 14 and rear treadway 46. Thereafter, the vehicle may be elevated, if desired, by bottle jacks or floor jacks and the vehicle engagement means 20, such as the pinchweld clamp 32 attached thereto to restrain the vehicle from movement upon the application of corrective force thereto.

If the operator desires, the vehicle may be elevated so that the weight does not rest upon the front and rear treadways 42 and 46, and the front treadways and associated treadways support stands 37 and 45 removed, or any combination thereof removed to facilitate access to the damaged portion of the vehicle. Thus, it can be appreciated that the vehicle support arrangement 1 is well adapted for the shop owner who desires a lesser investment than a full sized body and frame rack but yet seeks to take full advantage of a floor anchor system and to quickly elevate and restrain a vehicle from movement It is to be understood that while certain forms of the invention have been illustrated and described, it is not to be limited to the specific form or arrangement of parts described and shown.

What is claimed and desired to be secured by Letters Patent is as follows:

1. A drive-on vehicle support arrangement for use with a floor anchor system comprising:

(a) a pair of parallel, vehicle supporting treadways, each of said treadways including:

(i) vehicle support stand means having means connectible to a floor anchor pot to secure said support stand means connectible to the undercarriage of a vehicle to restrain same for pulls and pushes thereon;

(ii) treadway means and means for detachable connection of said treadway means to said vehicle support stand means in longitudinal alignment therewith;

(iii) treadway support means elevating said treadway means above a floor surface and horizontally level with said vehicle support means;

(iv) said means for detachable connection include apertures and tabs extending between said treadway means and said vehicle support stand means and said treadway support means whereby said treadway means is liftable in and out of engagement with said vehicle support stand means said treadway support means;

(v) entrance ramps means associated with said treadway means for driving a vehicle thereon;

(b) whereby said treadways are arranged in parallel relation so that a vehicle may be positioned thereon by its wheels and said treadway means removed for access to said vehicle to facilitate repair.

2. A drive-on vehicle supporting arrangement for use with a floor anchor system including a pair of parallel, vehicle supporting treadways each comprising:

(a) front and rear vehicle support stands each including floor engagement means depending therefrom for anchoring to a floor anchor, and vehicle engagement means extending upwardly therefrom for connection to the undercarriage of a vehicle to restrain said vehicle for repair of collision damage;

(b) said vehicle support stands include an upper planar member, a frame supporting said engagement means slidable longitudinally on said planar member, an upright base and means slidably mounting said base to said frame to transverse movement thereon;

(c) a front treadway support stand positioned forwardly of said front vehicle support stand and having a vehicle stop associated therewith;

(d) a front treadway extending between said front treadway support stand and said front vehicle support stand;

(e) a middle treadway extending between said front and rear vehicle support stands;

(f) a rear treadway support stand positioned rearwardly of said rear vehicle support stand;

(g) a rear treadway extending between said rear vehicle support stand and said rear treadway support stand;

(h) an inclined ramp connected to said rear treadway support stand for driving a vehicle from a floor surface onto said treadways; and (i) means for removably connecting said treadways to said treadway support stands and said vehicle support stands in longitudinal alignment whereby a vehicle may be elevated and restrained from movement and said treadway may be removed for access to the vehicle undercarriage.

3. A drive-on vehicle support arrangement for use with a floor anchor system comprising:

(a) a pair of parallel, vehicle supporting treadways, each of said treadways including:

(i) vehicle support stand means having means connectible to a floor anchor pot to secure said support stand means relative to a floor, and vehicle engagement means connectible to the undercarriage of a vehicle to restrain same for pulls and pushes thereon;

(ii) said vehicle engagement means including pinchweld clamps;

(iii) treadway means and means for detachable connection of said treadway means to said vehicle support stand means in longitudinal alignment therewith;

(iv) treadway support means elevating said treadway means above a floor surface and horizontally level with said vehicle support means;

(v) entrance ramp means associated with said treadway means for driving a vehicle thereon;

(b) whereby said treadways are arranged in parallel relation so that a vehicle may be positioned thereon by its wheels and said treadways means removed for access to said vehicle to facilitate repair.

4. A drive-on vehicle supporting arrangement for use with a floor anchor system and including a pair of parallel, vehicle supporting treadways separable into components, said treadways comprising:

(a) vehicle support means extending along and above a floor surface and including floor engagement means depending therefrom for anchoring to a floor anchor;

(b) vehicle engagement means secured to and extending upwardly from said vehicle support means, said vehicle engagement means being for connection to the undercarriage of a vehicle and securing said vehicle against movement while repairing collision damage;

(c) treadways means extending along and above a floor surface and means detachably connecting said treadway means to said vehicle support means in longitudinal alignment for drawing a vehicle over said treadway means and positioning said vehicle over said vehicle support means;

(d) treadways means elevating said treadway means above said floor surface and horizontally level with said vehicle support means; and (e) ramp means for access of a vehicle to said treadway means and said vehicle support means.

* * * * *